US005991919A

United States Patent [19]

Baggetto

[11] Patent Number: 5,991,919

[45] Date of Patent: Nov. 30, 1999

[54] STAY DRY COLLAR

[76] Inventor: Arlene Baggetto, 6455 W. Belle Plaine, Apt. 501, Chicago, Ill. 60634

[21] Appl. No.: 09/012,102

[22] Filed: Jan. 22, 1998

[51] Int. Cl.[6] ..... A41B 13/00

[52] U.S. Cl. ..... 2/50; 2/49

[58] Field of Search ..... 2/46, 48, 49.1, 2/49.2, 49.3, 49.4, 49.5, 50, 51, 52, 174, 129, 131, 132, 133, 134, 135, 136, 139, 143, 60, 88

[56] References Cited

U.S. PATENT DOCUMENTS

| | | | |
|---|---|---|---|
| 2,492,599 | 12/1949 | Smith . | |
| 2,621,330 | 12/1952 | Musse-White . | |
| 2,947,004 | 8/1960 | Pfile . | |
| 4,442,552 | 4/1984 | Bolick et al. . | |
| 5,491,844 | 2/1996 | Kehl et al. | 2/49.1 |
| 5,809,568 | 9/1998 | Morris-James | 2/49.1 |

*Primary Examiner*—Gloria Hale

*Attorney, Agent, or Firm*—Hill & Simpson

[57] ABSTRACT

A stay dry collar is provided to prevent wetting of a customer's clothing around the collar during shampooing or other beauty salon operations. A thermoplastic polymer sheet having moisture barrier properties is provided with score lines defining an inverted V-shaped configuration. The score lines arranged in the inverted-V permit separation of the sheet along the scores to define a center tuck flap and left and right tie panels. After separation, the central tuck panel may be tucked between the customer's clothing and the customer's skin. The left and right tie panels may be gathered together, brought to the other side of the person's neck and then tied to secure the stay dry collar in place. The central tuck panel has a length sufficient to provide meaningful three-sided protection for preventing undesirable wetting of a customer's garments during and after shampooing or during other beauty treatments. The stay dry collar is intended for sanitary, one time disposable use and reduces the expense associated with extra towels and laundering of the towels in beauty salon operations.

20 Claims, 1 Drawing Sheet

STAY DRY COLLAR

BACKGROUND OF THE INVENTION

The present invention generally relates to the art of salon shampooing and other beauty treatment procedures. More particularly, it relates to a new and improved disposable stay dry collar which is specially designed to prevent undesirable wetting of a customers garments during and after shampooing or other beauty treatment operations.

Nowadays, almost all styling and beauty care operations begin with a thorough shampooing. When hair is washed in a beauty salon, the customer sits in a chair which reclines rearwardly toward a shampooing sink. The sink is provided with a front dugout section to receive the customer's neck so that the head and hair extend into the sink basin. A spray nozzle connected to a flexible hose is manipulated by the operator to wet and rinse the customer during shampooing. In order to thoroughly rinse the customer's hair, the operator frequently extends the nozzle into the sink and directs the flow of water against the back of the customer's head and neck area to thoroughly rinse shampoo or other chemical treatments from the customer's head.

Various devices have been used to cover the customer in an attempt to prevent water from splashing or dripping onto the customer's clothes or the chair. Frequently, a towel is tucked into the customer's collar. However, cotton towels are wetted during the shampooing and rinsing operations. The cotton towel material may actually wick and transmit water from the sprayer nozzle and customer's hair toward the customer's clothing thereby wetting the customers garments. Another shortcoming of using a towel as a wetness barrier is that a number of towels must be used which must be properly laundered. This leads to an extra expenditure of time, energy and money, which is undesirable.

Another method which has been used to cover a customer in an attempt to prevent water from splashing or dripping from the hair onto the customer, the customer's clothes and/or the shampooing chair, has been a plastic or vinyl cape or drape which is placed over the customer and secured to the customer's neck prior to shampooing. These vinyl drapes typically have a cotton tape edge binding which touches the neck of the customer's skin in use. To provide for customer comfort, these drapes are relatively loosely secured about the neck area so that they do not provide a water tight seal at the skin of the customer's neck and accordingly, ingress of water or other chemicals is possible. Moreover, the cotton tape along the neck engaging edge of these drapes can also provide a wicking action which actually transmits the water toward the customers clothing disposed under the drapes, which is undesirable.

A new and improved cape having a separate back splash guard panel is described in U.S. Pat. No. 4,709,420. The splash guard panel prevents splashing through the open back portion of the cape below the neck line during shampooing. However, this shampoo cape still has a neck portion provided with a cotton binder so that it suffers from the same drawbacks mentioned above.

Generally, vinyl drapes are intended to be used over and over again. Reuse of the drapes raises health concerns with respect to the transmission of disease. Accordingly, these drapes should be used once and laundered between uses, which dramatically increases the cost to the salon owner. The drapes are too expensive to be treated as disposable items.

SUMMARY OF THE INVENTION

Accordingly, to overcome the shortcomings and the disadvantages of the prior art devices, it is an object of the present invention to provide a new and improved stay dry collar which is sanitary, adapted for a single use, which effectively prevents wetting of the customer's clothing during shampooing or other beauty operations from the inside and out.

In accordance with these and other objects, the present invention provides a new and improved stay dry collar for preventing wetting of a customer's clothing during beauty treatment operations. The new and improved stay dry collar comprises a flexible, moisture impermeable sheet. The sheet has a top edge and an upper region adjacent the edge. A first and second perforated score line is provided in the upper region which extends from the top edge into the upper region. The first and second score lines are disposed at an angled orientation with respect to each other so that the sheet may be separated along the first and second score lines to define a central tuck panel, a left tie panel and a right tie panel in the upper region. The sheet may be affixed around the neck of a customer so that the central tuck panel is tucked into a collar of the person's clothing so that it extends between the skin and the clothing. The left tie panel and the right tie panel are passed around the neck of the customer and tied together on a side opposite to the tucked central tuck panel to secure the sheet in position. The remaining portions of the sheet overlie the collar and exterior portions of the clothing to provide the stay dry collar.

In accordance with the preferred embodiment, the sheet preferably comprises a thermoplastic polymer film sheet and preferably is a unitary or one piece sheet. The thermoplastic polymer sheet material may be selected from the group consisting of olefinic polymers, olefinic copolymers and polyesters. Especially preferably, the thermoplastic polymer film sheet will comprise a low density polyethylene film sheet material. In accordance with the preferred embodiment, the thermoplastic polymer film sheet may have a sheet thickness of from about 0.0005 to about 0.010 inches.

Preferably, the thermoplastic polymer film sheet has a generally rectangular configuration including a length and a smaller width and the top edge is defined along a shorter side of the rectangular sheet. The first and second score lines preferably are disposed at an angled orientation with respect to each other so as to define an inverted v-shaped configuration. Accordingly, the central tuck panel preferably has a trapezoidal configuration including a smaller base having a first width defined along the top edge and a larger base having a second larger width in said upper region defined between an inner end of the first score line and an inner end of the second score line. The second larger width is preferably sufficiently long so that the folded polymer film sheet extends along the customers collar from ear to ear. Preferably, the central tuck panel has a length defined between the first base and the second base which is long enough to provide meaningful wetness protection and preferably has a length of at least 5 inches, especially preferably having a length of from about 8 to about 12 inches.

A major advantage provided by the new and improved stay dry collar of the present invention is that it provides a sanitary one-time use device for each client which prevents transfer of germs or bacteria from one client to another.

Another advantage provided by the present invention is that, a stay dry collar is provided which is comfortable and which prevents small hairs from sticking to the client's collar when cutting hair.

A further advantage provided by the present invention is that, a new and improved stay dry collar is provided which is economical and provides meaningful savings to a salon operator because it saves the cost and expense associated with the extra towels now required to protect customers clothing and the laundering of those towels.

Still another advantage of the present invention is that it saves the costs of laundering the extra towels and the extra water used in laundering the towels to provide a more environmentally friendly method for preventing wetting of a customer's clothing during salon operations.

Still a further advantage of the present invention is that it provides a stay dry collar which protects clients clothing from the inside and out and which extends along the client's collar for a length more than sufficient to protect the client's clothing from getting wet during most shampooing and rinsing operations.

Other objects and advantages of the present invention will become apparent from the following Detailed Description taken in conjunction with the Drawings, in which:

DETAILED DESCRIPTION OF THE PREFERRED EMBODIMENT

Figure 2:
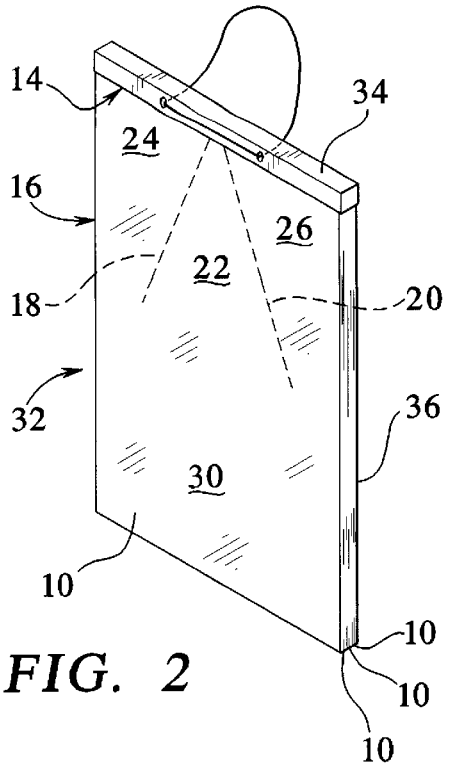
FIG. 2 is a perspective view of a supply of the new and improved stay dry collars of the present invention.
Figure 3:
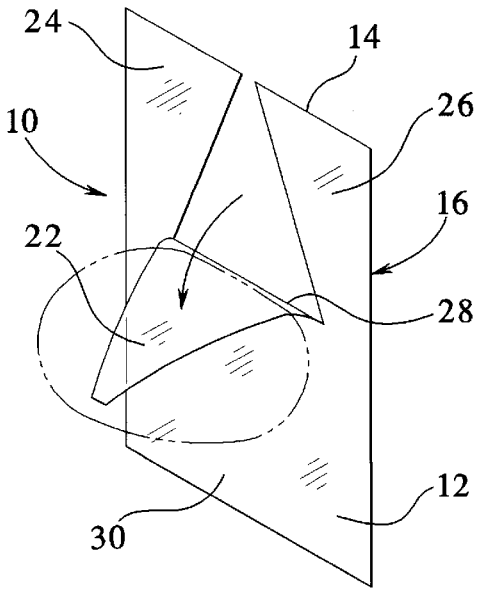
FIG. 3 is a perspective view of the new and improved stay dry collar of the present invention with the sheet separated along the perforated score lines to show the central tuck panel and the left and right tie panels.
Figure 4:
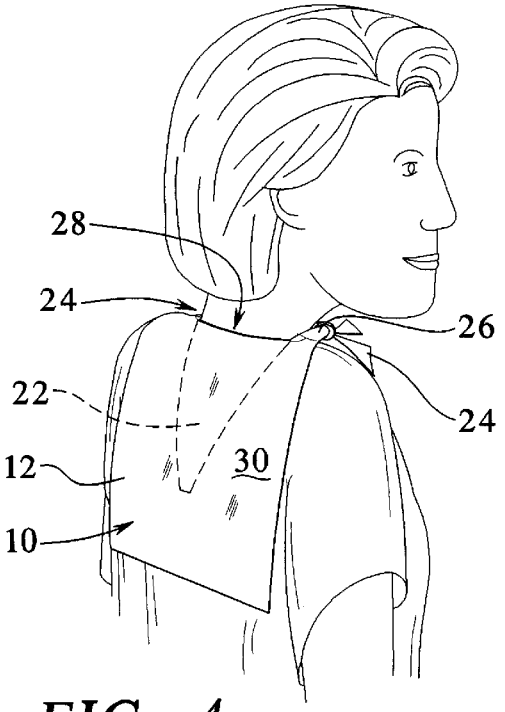
FIG. 4 is a perspective view showing the new and improved stay dry collar affixed to a customers neck with the central tuck panel shown tucked for use during beauty treatment operations.

Referring now to FIGS. 1–4, the new and improved stay dry collar of the present invention, generally referred to by reference numeral 10 is shown. Stay dry collar 10 comprises a flexible, moisture impermeable thermoplastic polymer film sheet 12. Thermoplastic polymer film sheet 12 has a top edge 14 and an upper region 16 generally defined adjacent the top edge. A first perforated score line 18 extends inwardly from top edge 14 into upper region 16. A second perforated score line 20 extends inwardly from top edge 14 into upper region 16. The first score line 18 and the second score fine 20 are disposed at an angled orientation with respect to each other. Thermoplastic polymer film sheet 12 is separable along the first and the second score lines 18 and 20, respectively, to define a central tuck panel 22, a left tie panel 24 and a right tie panel 26 in the upper region 16. Stay dry collar 10 may be affixed around the neck of a person as shown in FIG. 4 so that the central tuck panel 22 is tucked into a collar of the person's clothing so that it extends between the skin and the clothing. Left tie panel 24 and right tie panel 26 are passed around the neck of the customer and tied together on a side opposite the central tuck panel as shown in FIG. 4 to secure the stay dry collar in position for use. The remaining outer panel portion 30 of thermoplastic polymer film sheet 12 overlies the collar exterior portions of the customer's clothing to prevent the customer's clothing from being wetted during shampooing, rinsing or other beauty operations.

Figure 1:
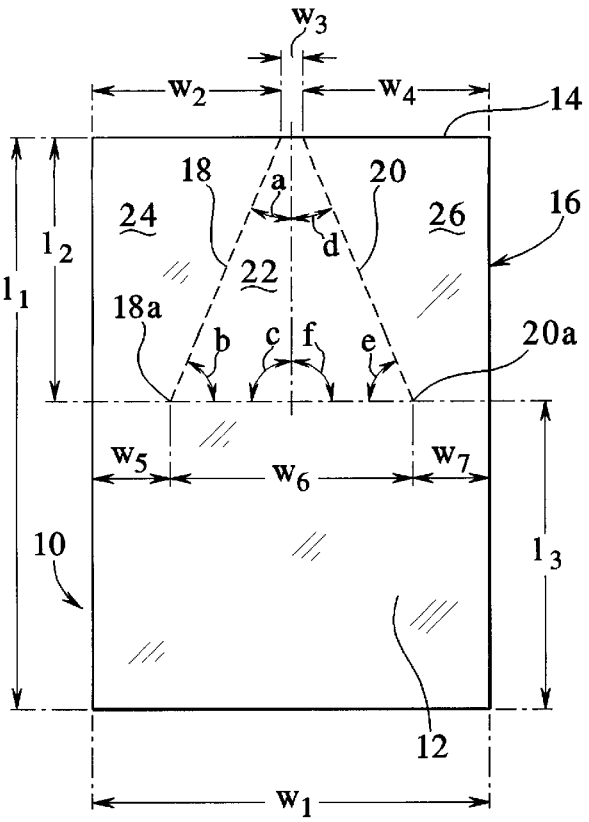
FIG. 1 is a plan view of the new and improved stay dry collar of the present invention.

In greater detail now and referring to FIGS. 1 and 3, stay dry collar 10 comprises a thermoplastic polymer film sheet 12 having a generally rectangular configuration including a length, $I_1$, and a smaller width, $w_1$. Thermoplastic polymer film sheet 12 has a thickness sufficient to impart moisture barrier properties and preferably has a thickness of from about 0.0005 to about 0.010 inches. The thermoplastic polymer material for forming polymer film sheet 12 may comprise a thermoplastic polymer material conventionally formed into films by blow molding or other methods including, for example, without limitation, olefinic polymers, olefinic copolymers and polyesters. The thermoplastic polymer film sheet may comprise a thermoplastic polymer material selected from polyethylene, ethylene copolymers, polypropylene, polypropylene copolymers, polystyrene, polystyrene copolymers, polyvinyl alcohol, vinyl alcohol copolymers, polyvinyl chloride, vinyl chloride copolymers, polyvinyl acetate and vinyl acetate copolymers. Especially preferably, the thermoplastic polymer film sheet will comprise a low density polyethylene having a film thickness of about 0.001 inches. Suitable thermoplastic polymer film sheet materials are abundantly commercially available. Methods for forming perforated score lines in plastic film sheet materials are also known to those skilled in this art.

In the preferred embodiment shown in FIGS. 1 and 3, the new and improved stay dry collar 10 includes first and second score lines 18 and 20 which are disposed at an angled orientation with respect to each other so as to form an inverted V-shaped configuration. As a result, the central tuck panel 22 has a trapezoidal configuration including a smaller base having a first width, $w_3$, defined along the top edge 14 and a larger base having a second larger width, $w_8$, defined in the upper region 16 between an inner end 18*a* of the first score line 18 and an inner end 20*a* of the second score line 20. The central tuck panel 22 has a length, $I_2$, defined as the perpendicular distance between the first base and the second base. Preferably, the central tuck panel is provided with a length $I_2$ sufficiently long to provide a meaningful tuck-in, barrier protection between the inside of the customer's clothing and the customers skin. The length $I_2$ is preferably at least about 5 inches and especially preferably is from about 8 to about 12 inches or more. The angular orientation of first score line 18 to second score line 20 should define a fold line along the second base of the central tuck portion having a width, $w_6$, which is sufficiently long to extend along the person's collar from more than half way around the collar portion, for example, preferably from ear to ear or more preferably from collar bone to collar bone. Accordingly, width dimension $w_6$ should have a length which is at least about 8 inches and preferably which is about 10 to about 14 inches.

In the preferred embodiment shown in FIGS. 1–4, polymer film sheet 12 preferably has a length dimension $I_1$ of about 26 inches and an overall width dimension $w_1$ of about 18 inches. The central tuck panel is defined in polymer film sheet 12 by appropriate placement of the first score line 18 and the second score line 20. In accordance with the preferred embodiment, these score lines are placed so that the first base of the central tuck panel 22 has a width, $w_3$, of about 1 inch which is generally centrally located along the top edge 14 of the polymer film sheet 12. Accordingly, the width dimensions $w_2$, $w_3$ and $w_4$ defined along the top edge 14 are about 8.5, about 1.0 and about 8.5 inches, respectively. The $I_2$ dimension, representing the height of the trapezoidal central tuck panel 22 defined between the first base and the second base is preferably about 12 inches. In the preferred embodiment depicted in FIGS. 1–4, the larger base of the central tuck panel 22 defined between end point 18*a* and end point 20*a* has a width dimension, $w_6$, of preferably about 12 inches. Accordingly, width dimensions $w_5$ and $w_7$, as shown, are each about 3 inches, respectively.

In the preferred embodiment shown in FIG. 1, the angular orientation of the first score line is such that angles a, b and c are preferably 30°, 60° and 90°, respectively. Similarly, the angles d, e and f for the second score line 20 shown in FIG. 1 are also 30°, 60° and 90°, respectively. The angles and lengths may be varied from these preferred dimensions without losing the beneficial advantages provided by the present invention. These dimensions are currently preferred because they provide a stay dry collar which provides effective anti-wetness protection.

Referring now to FIG. 2, in accordance with the preferred embodiment, a hanging supply 32 of stay dry collars 10 may be provided. Hanging supply 32 comprises a plurality of stay dry collar sheets 10 bound together with a top binding 34 and supported by a cardboard backing layer 36. The top binding 34 may be provided by a number of methods for securing the stay dry collar sheets together including thermal welding, stitching, adhesive bonding or mechanical fastening, by means of staples or brads or the like. A top edge 14 may be formed by a third perforated score line so that each individual stay dry collar 10 may be tom from the supply along a scored top edge 14. Once an individual stay dry collar sheet 10 is removed from the supply, the thermoplastic polymer film sheet can be separated along the first score line 18 and second score line 20 to define the central tuck panel 22, left tie panel 24 and right tie panel 26 as shown in FIG. 3. The central tuck panel 22 may be tucked into the customer's clothing as shown in FIG. 4. The length 12 of the central tuck panel is sufficiently long to provide a meaningful moisture barrier between the customer's skin and the customer's clothing which extends downwardly from the collar by an amount of 5 inches and preferably from 8 to 12 inches. In tucked and folded over condition, the stay dry collar 10 forms a U-shaped fold 28 around the collar of the customer which includes three sided protection including an inner panel 22, a top fold 28 and an outer panel 30. Moreover, the U-shaped folded region 28 has a width, $w_6$, which is sufficiently long to extend along the collar of the customer, over half the usual collar width, so that the customer is provided with three sided anti-wetness protection from ear to ear and preferably from collar bone to collar bone. The length $I_2$ is sufficient to provide a length for left tie panel 24 and right tie panel 26 so that they may easily be passed around the neck of the customer and tied together as shown in FIG. 4 to secure the tucked stay dry collar in position for use.

The new and improved stay dry collar provides a number of distinct advantages compared to prior art methods employed to keep the customer's clothing dry. More particulary, in accordance with the present invention, there is a three sided covering or waterproof barrier which extends along the collar of the customer's clothing to provide meaningful wetness protection. In contradistinction, the prior art devices only have a one sided barrier with no internal panel, which permits entry or wicking of fluid in at the top of the neck of the drapes. The new and improved stay dry collar does not have an open back which can separate as the customer leans back in the chair to provide an opening and opportunity for getting wet due to splashing during rinsing and shampooing. The new and improved stay dry collar is easy to install and use. To the extent any moisture attempts to enter between the central tuck panel 22 and the person's skin, because the central tuck panel extends inwardly and downwardly such a length, any moisture will tend to evaporate due to the customer's body heat before it will allow the moisture to travel downwardly enough to wet a person's clothing at the inner end of the central tuck panel. Moreover, because the central tuck panel is made of a thermoplastic polymer film material, it will actually releaseably adhere to the customer's skin so that water will not enter at the point of contact but instead will most likely flow over the U-shaped folded region 28 back into the wash basin.

The new and improved stay dry collar 10 provides a number of advantages for the salon operator. The stay dry collar meets the salon operator's needs for a sanitary one-time use disposable covering to prevent the transfer of germs from one customer to another. The new and improved stay dry collar reduces the number of towels needed in beauty operations and dramatically reduces the costs of purchasing and laundering extra towels previously required.

Although the present invention has been described with reference to certain preferred embodiments, modifications or changes may be made, therein, by those skilled in this art. The thermoplastic polymer film sheet may be selected from polymer film sheets other than the preferred low density polyethylene material. The precise dimensions set forth in the preferred embodiment may be varied by those skilled in the art without departing from the present invention provided the remaining dimensions are such as to provide meaningful three sided anti-wetness protection for the central tuck panel as shown herein. Although the stay dry collar is shown in use, positioned at the back of the customer, the stay dry collar could be applied at the front of the customer's collar for performing other beauty operations such as makeup, facial masks and waxing. All such obvious modifications or changes may be made herein without departing from the scope and spirit of the present invention as defined by the appended claims.

What is claimed is:

1. A stay dry collar comprising:

a flexible, moisture impermeable sheet having a top edge and an upper region adjacent the top edge, a first and a second perforated score line extending inwardly from the top edge into the upper region, said first and second score lines being disposed at an angled orientation with respect to each other, said sheet being separable along the first and the second score lines to define a unitary central tuck panel, a left fie panel, and a right tie panel in said upper region, said central tuck panel having a base extending between said first and second score lines and having a width which is sufficiently long to extend from ear to ear along a back of a person's neck, whereby said sheet may be affixed around the neck of the person so that the central tuck panel is tucked into a rear collar of the person's clothing extending between the skin and the clothing and the left tie panel and the right tie panel are passed around the neck and tied together in front of the neck to secure the sheet in position and remaining portions of the sheet overlay the collar and exterior portions of the clothing to provide said stay dry collar.

2. A stay dry collar as defined in claim 1, wherein the first score line and the second score line are disposed at an angled orientation with respect to each other in an inverted v-shaped configuration.

3. A stay dry collar as defined in claim 1, wherein said central tuck panel has a trapezoidal configuration including a smaller base having a first width defined along said top edge and a larger base having a second larger width in said upper region defined between an inner end of said first score line and an inner end of said second score line.

4. A stay dry collar as defined in claim 3, wherein said second larger width is at least about 8.0 inches.

5. A stay dry collar as defined in claim 3, wherein said central tuck panel has a length defined as a perpendicular distance between said first base and said second base of at least about 5.0 inches.

6. A stay dry collar as defined in claim 1, wherein said sheet comprises a thermoplastic polymer film sheet.

7. A stay dry collar as defined in claim 6, wherein said thermoplastic polymer film sheet is a disposable unitary sheet intended for one-time use.

8. A stay dry collar as defined in claim 6, wherein said thermoplastic polymer film sheet comprises a thermoplastic polymer material selected from the group consisting of olefinic polymers, olefinic copolymers and polyesters.

9. A stay dry collar as defined in claim 6, wherein said thermoplastic polymer film sheet comprises a thermoplastic polymer material selected from polyethylene, ethylene copolymers, polypropylene, propylene copolymers, polystyrene, styrene copolymers, polyvinyl alcohol, vinyl alcohol copolymers, polyvinyl chloride, vinyl chloride copolymers, polyvinyl acetate and vinyl acetate copolymers.

10. A stay dry collar as defined in claim 6, wherein said thermoplastic polymer film sheet has a sheet thickness of between about 0.0005 to about 0.010 inches.

11. A stay dry collar as defined in claim 6, wherein said thermoplastic polymer film sheet has a generally rectangular configuration.

12. A stay dry collar as defined in claim 6, wherein said thermoplastic polymer film sheet has a generally rectangular configuration including a length and a smaller width and said top edge is defined by a shorter side of said rectangular sheet.

13. A method for preventing wetting of a customers clothing during beauty treatment operations comprising the steps of:

preparing a stay dry collar supply including at least one stay dry collar, said stay dry collar comprising a flexible, moisture impermeable thermoplastic polymer film sheet having a top edge and an upper region adjacent the top edge, a first and a second perforated score line extending inwardly from the top edge into the upper region, said first and second score lines being disposed at an angled orientation with respect to each other; separating said sheet by tearing the sheet along the first and the second score lines to define a unitary central tuck panel, a left tie panel, and a right tie panel in said upper region, said central tuck panel having a base extending between said first and second score lines and having a width which is sufficiently long to extend from ear to ear along a back of a person's neck;

affixing the sheet around the neck of the person by tucking the central tuck panel into a rear collar of the person's clothing so that the central tuck panel extends between the skin and the clothing and passing the left tie panel and the right tie panel around to a front of the neck and tying the left tie panel and the right tie panel together to secure the sheet in position so that remaining portions of the sheet overlay the collar and exterior portions of the clothing to prevent wetting of the person's clothing during beauty treatment operations.

14. A method for preventing wetting of a person's clothing as defined in claim 13, wherein said tuck panel is tucked into a back portion of the collar of the person's clothing.

15. A method for preventing wetting of a person's clothing as defined in claim 13, wherein the first score line and the second score line are disposed at an angled orientation with respect to each other in an inverted v-shaped configuration.

16. A method for preventing wetting of a person's clothing as defined in claim 13, wherein said central tuck panel has a trapezoidal configuration including a smaller base having a first width defined along said top edge and a larger base having a second larger width in said upper region defined between an inner end of said first score line and an inner end of said second score line.

17. A method for preventing wetting of a person's clothing as defined in claim 13, wherein said second larger width is at least about 8.0 inches.

18. A method for preventing wetting of a person's clothing as defined in claim 13, wherein said central tuck panel has a length defined as a perpendicular distance between said first base and said second base of at least about 5.0 inches.

19. A method for preventing wetting of a person's clothing as defined in claim 13, wherein said thermoplastic polymer film sheet is a disposable unitary, one-piece sheet, intended for one time use.

20. A stay dry collar as defined in claim 1, wherein said thermoplastic polymer film sheet has a sheet thickness of between about 0.0005 to about 0.010 inches.

* * * * *